US008311461B2

(12) United States Patent
Jeon et al.

(10) Patent No.: US 8,311,461 B2
(45) Date of Patent: Nov. 13, 2012

(54) IMAGE FORMING APPARATUS, DEVELOPING DEVICE INCLUDING DEVELOPER CONTACT MEMBER AND DEVELOPER CARTRIDGE THEREOF

(75) Inventors: In Cheol Jeon, Yongin-si (KR); Jong In Kim, Suwon-si (KR); Sung Gi Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 279 days.

(21) Appl. No.: 12/468,263

(22) Filed: May 19, 2009

(65) Prior Publication Data

US 2009/0304413 A1 Dec. 10, 2009

(30) Foreign Application Priority Data

Jun. 5, 2008 (KR) ..... 10-2008-0053276

(51) Int. Cl.
*G03G 21/00* (2006.01)
*G03G 15/08* (2006.01)

(52) U.S. Cl. ..... 399/258; 399/99; 399/120

(58) Field of Classification Search ..... 399/99, 399/120, 258, 260, 262, 263, 273, 283
See application file for complete search history.

(56) References Cited

U.S. PATENT DOCUMENTS 4,999,675 A * 3/1991 Speer et al. ..... 399/273

FOREIGN PATENT DOCUMENTS

| | | |
|---|---|---|
| EP | 0 699 971 | 3/1996 |
| JP | 09-185241 | 7/1997 |
| JP | 10-153906 | 6/1998 |
| JP | 2005-189692 | 7/2005 |

OTHER PUBLICATIONS

English Abstract of JP-2005-189692.
Machine English translation of JP-2005-189692.
European Search Report issued in counterpart European Application No. EP 09 16 1257, mailed Sep. 21, 2009.
English language abstract of JP 09-185241, published Jul. 15, 1997.
Machine English language translation of JP 09-186241, published Jul. 15, 1997.
English language abstract of JP 10-153906, published Jun. 9, 1998.
Machine English language translation of JP 10-153906, published Jun. 9. 1998.

* cited by examiner

*Primary Examiner* — Joseph S Wong
(74) *Attorney, Agent, or Firm* — Stanzione & Kim, LLP

(57) ABSTRACT

An image forming apparatus, a developing device and a developer cartridge are disclosed. The developer cartridge includes a cartridge housing and a developer delivery unit to deliver a developer received in the cartridge housing. The developer delivery unit includes a delivery member and a contact portion to come into contact with the delivery member. The contact between the contact portion and the delivery member form a length longer than a straight line connecting one end of the contact portion to the other end.

15 Claims, 8 Drawing Sheets

IMAGE FORMING APPARATUS, DEVELOPING DEVICE INCLUDING DEVELOPER CONTACT MEMBER AND DEVELOPER CARTRIDGE THEREOF

CROSS-REFERENCE TO RELATED APPLICATION

This application claims the benefit of Korean Patent Application No. 10-2008-0053276, filed on Jun. 5, 2008 in the Korean Intellectual Property Office, the disclosure of which is incorporated herein by reference.

TECHNICAL FIELD

The present invention relates to an image forming apparatus, and a developing device and a developer cartridge thereof, and, more particularly, to an image forming apparatus, and a developing device and a developer cartridge thereof, which can achieve efficient feeding of developer.

BACKGROUND OF RELATED ART

An image forming apparatus is an apparatus that forms an image on a printing medium according to input signals. Examples of the image forming apparatus include printers, copiers, facsimiles, devices combining some or all functions thereof, and the like.

Broadly speaking, in an electro-photographic type image forming apparatus as one type of image forming apparatus, light is irradiated on an image carrier charged with a predetermined electric potential, to form an electrostatic latent image on a surface of the image carrier. As a developer is fed to the electrostatic latent image, a visible image is formed on the image carrier. The visible image formed on the image carrier is transferred to a printing medium directly or by way of an intermediate transfer member. The image transferred to the printing medium is fixed to the printing medium via a fixing process.

The developer, to be attached to the image carrier so as to produce an image, is received in a developer cartridge. The developer, received in the developer cartridge, is delivered by a developer delivery unit provided in the developer cartridge, and is fed to a developing unit through a feed hole perforated in the developer cartridge.

The developer delivery unit, which may be provided adjacent to the feed hole of the developer cartridge, includes a delivery member to deliver the developer via rotation thereof. The amount of the developer, which is attached to and delivered by the delivery member, may depend upon, for example, the rotating speed of the delivery member and the degree of interference between the delivery member and the contact portion of a receiving member that is used to receive the delivery member.

The contact portion comes into contact with a surface of the rotating delivery member, and separates the developer from the delivery member. The greater the interference between the delivery member and the contact portion, the greater the amount of the developer separated from the surface of the delivery member, causing a greater amount of the developer to be delivered.

The developer separated from the delivery member by the contact portion is discharged from the developer cartridge through the feed hole, and the discharged developer is fed to a developing roller that applies the developer to the image carrier.

As described above, to increase the amount of the developer to be fed, it is necessary to increase the interference by the contact portion that is used to separate the developer attached to the surface of the delivery member.

Conventional image forming apparatuses have attempted to forcibly press the contact portion toward the delivery member in order to increase the amount of the developer to be separated. While such forcible pressing contact may increase the interference, resulting greater separation of the developer from the surface of the delivery member, and consequently, an increased amount of the developer fed, the increased contact pressure may also increase the likelihood of abrasion of, and damage to, the surface of the delivery member.

During operation, the delivery member repeats rotation and stoppage according to the variation in the amount of the developer supplied to the image carrier. The forcible pressing of the contact portion toward the surface of the delivery member may unfortunately also increase the starting load on rotation of the delivery member to an undesirable level.

SUMMARY OF DISCLOSURE

According to an aspect of the present disclosure, a developer cartridge may be provided to include a cartridge housing and a first developer delivery unit disposed in the cartridge housing, the first developer delivery unit being configured to deliver an amount of developer from the cartridge housing outside the cartridge housing, the first developer delivery unit including a delivery member and a contact portion configured to come into contact with the delivery member, the contact portion having a length from one end thereof to the other end that is longer than a straight line between the ends of the contact portion.

The contact portion may include at least one first contact portion and at least one second contact portion. Each of the at least one first contact portion may be non-parallel to the at least one second contact portion and non-parallel to the straight line.

The at least one first contact portion may comprise a plurality of first contact portions, the at least one second contact portion comprising a plurality of second contact portions. The plurality of first contact portions and the plurality of second contact portions may be arranged in an alternating manner.

Both the at least one first and at least one second contact portions may maintain a predetermined angle with respect to the straight line.

Any one of the at least one first and the at least one second contact portions may be curved.

The developer delivery unit may further include a receiving member configured to receive therein the delivery member.

The contact portion may comprise a contact rib protruding from the receiving member toward the delivery member.

The receiving member may have formed therein a feed hole, through which the developer is discharge out of the cartridge housing.

The delivery member may rotate in a rotational direction about a rotational axis. The feed hole may be defined between a first sidewall and a second sidewall. The first sidewall may be further downstream of the second sidewall with respect to the rotational direction of the delivery member. The rotational axis of the delivery member may be located closer to the first sidewall than to the second sidewall.

The contact portion may be provided adjacent the first sidewall of the feed hole.

The developer cartridge may further include a second developer delivery unit having a second delivery member. The delivery member of the first developer delivery unit may rotate in a direction opposite to a rotating direction of the second delivery member of the second developer delivery unit.

The at least second developer delivery unit may be disposed within the cartridge housing at a location lower that the first developer delivery unit to deliver the developer in the cartridge housing in an upward direction toward the first developer delivery unit.

According to another aspect, a developer cartridge may include a cartridge housing having a developer receiving space, a feed hole and a delivery member configured to discharge developer out of the cartridge housing through the feed hole. The developer cartridge may comprise a contact portion disposed on at least one side of the feed hole to come into an interfering contact with the delivery member in a manner such that the interfering contact does not form a single straight line across the length of the delivery member.

According to yet another aspect, a developer cartridge may include a cartridge housing having a developer receiving space and a delivery member configured rotate to discharge developer out of the cartridge housing. The developer cartridge may comprise a feed hole though which the developer is discharged out of the cartridge housing. The feed hole may define an elongated opening extending parallel to a rotational axis of the delivery member. A first peripheral side of the elongated opening may be longer that a second peripheral side of the elongated opening. The first peripheral side may be further downstream of the second peripheral side with respect to a rotating direction of the delivery member.

According to still another aspect, a developing device may include a developing member configured to convey developer to an image carrier. The developing device may comprise a developer cartridge that may be configured to feed the developer to the developing member. The developer cartridge may include a developer receiving space and at least one developer delivery unit to deliver the developer received in the developer receiving space. The developer delivery unit may include a delivery member and a contact portion configured to come into contact with the delivery member so as to cause separation of the developer attached to the delivery member. The contact between the contact portion and the delivery member may have a total contact length longer than a straight line connecting one end of the contact portion to the other end of the contact portion.

The contact portion may include at least one first contact portion and at least one second contact portion. Each of the at least one first contact portion may be non-parallel to the at least one second contact portion and non-parallel to the straight line.

The at least one first contact portion may comprise a plurality of first contact portions. The at least one second contact portion may comprise a plurality of second contact portions. The plurality of first contact portions and the plurality of second contact portions may be arranged in an alternating manner.

According to even yet another aspect, an image forming apparatus may include an exposing unit to irradiate light on an image carrier to form thereon an electrostatic latent image and a developing device including a developing member to convey developer to the image carrier. The image forming apparatus may comprise a developer cartridge configured to feed the developer to the developing member. The developer cartridge may include a developer delivery unit to deliver the developer received in the developer cartridge. The developer delivery unit may include a delivery member and a receiving member configured to receive the delivery member. The receiving member may have formed therewith a contact portion configured to come into contact with the delivery member. The contact portion may have at least two positions that may be spaced apart by different perpendicular distance from a straight line connecting one end of the contact portion to the other end of the contact portion.

The contact portion may include at least one first contact portion positions along which having increasing perpendicular distance from the straight line and at least one second contact portion positions along which having decreasing perpendicular distance from the straight line.

The at least one first contact portion may comprise a plurality of first contact portions. The at least one second contact portion may comprise a plurality of second contact portions. The plurality of first contact portions and the plurality of second contact portions may be arranged in an alternating manner.

BRIEF DESCRIPTION OF THE DRAWINGS

Various aspects of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
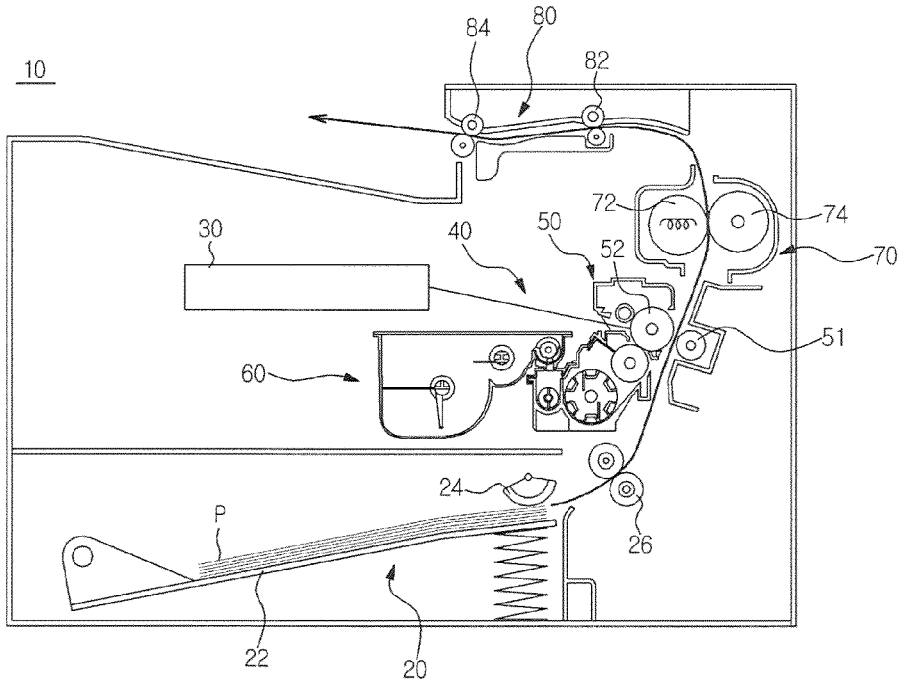
FIG. 1 is a sectional view illustrating an image forming apparatus in accordance with an embodiment of the present invention.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail.

Depicted in FIG. 1 is an image forming apparatus 10 in accordance with an embodiment of the present invention, which may include a paper feeding device 20, a light scanning device 30, a developing device 40, a transfer device 51, a fixing device 70 and a discharge device 80.

The paper feeding device 20 may include a tray 22 in which a printing medium P is loaded, and a pickup roller 24 to pick up the printing medium P loaded in the tray 22 sheet by sheet.

The printing medium P picked-up by the pickup roller 24 is delivered toward the developing device 40 by delivery rollers 26.

The light scanning device 30 irradiates light to an image carrier 52 before the printing medium P arrives at the developing device 40. A photosensitive latent image is formed on the surface of the image carrier 52 by the light irradiated from the light scanning device 30.

The developing device 40 may include a developing unit 50 and a developer cartridge 60. The present embodiment describes the developing unit 50 and the developer cartridge 60 as being provided individually. However, in alternative embodiments, for example, the developing unit 50 and the developer cartridge 60 may be integrally formed as a single unit, or the developing unit 50, the developer cartridge 60 and one or more of the other inner constituents of the image forming apparatus 10 may be integrally formed with one another. Although detailed configurations of the developing unit 50 and the developer cartridge 60 will be described hereinafter, note that the developer cartridge 60 feeds developer T (FIG. 2) stored therein to the developing unit 50 according to a control signal (not shown), and the developing unit 50 applies the developer T fed from the developer cartridge 60 to the image carrier 52 so as to form a visible image. The developer T attached to the image carrier 52 is transferred to the printing medium P. The printing medium P, to which the image is transferred while passing the developing device 40, is fed to the fixing device 70.

The fixing device 70 may include a heating roller 72 and a press roller 74. The image transferred to the printing medium P is fixed to the printing medium P by heat and pressure while the printing medium P passes between the heating roller 72 and the press roller 74.

The discharge device 80 may include first and second paper discharge rollers 82 and 84, and discharges the printing medium P, having passed through the fixing device 70, to the outside of the image forming apparatus 10.

Figure 2:
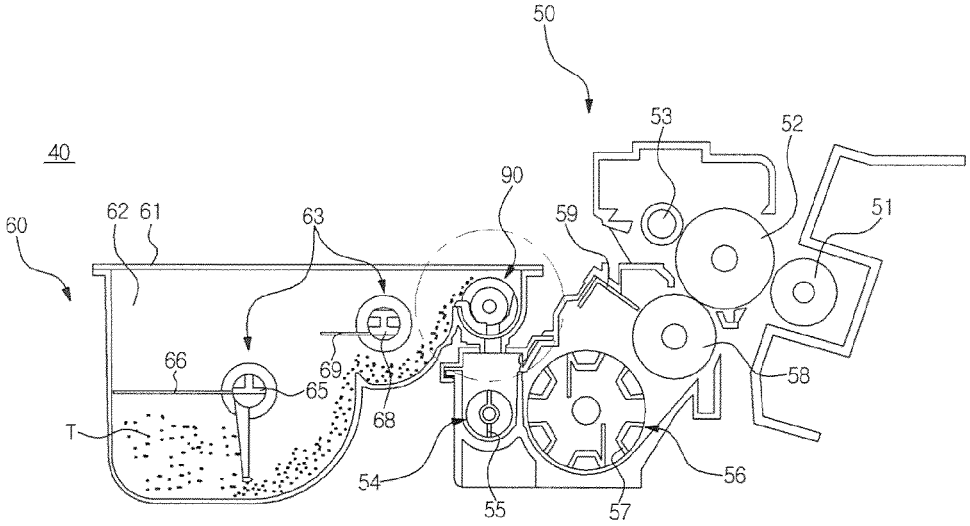
FIG. 2 is a sectional view illustrating a developing device of FIG. 1.
Figure 3:
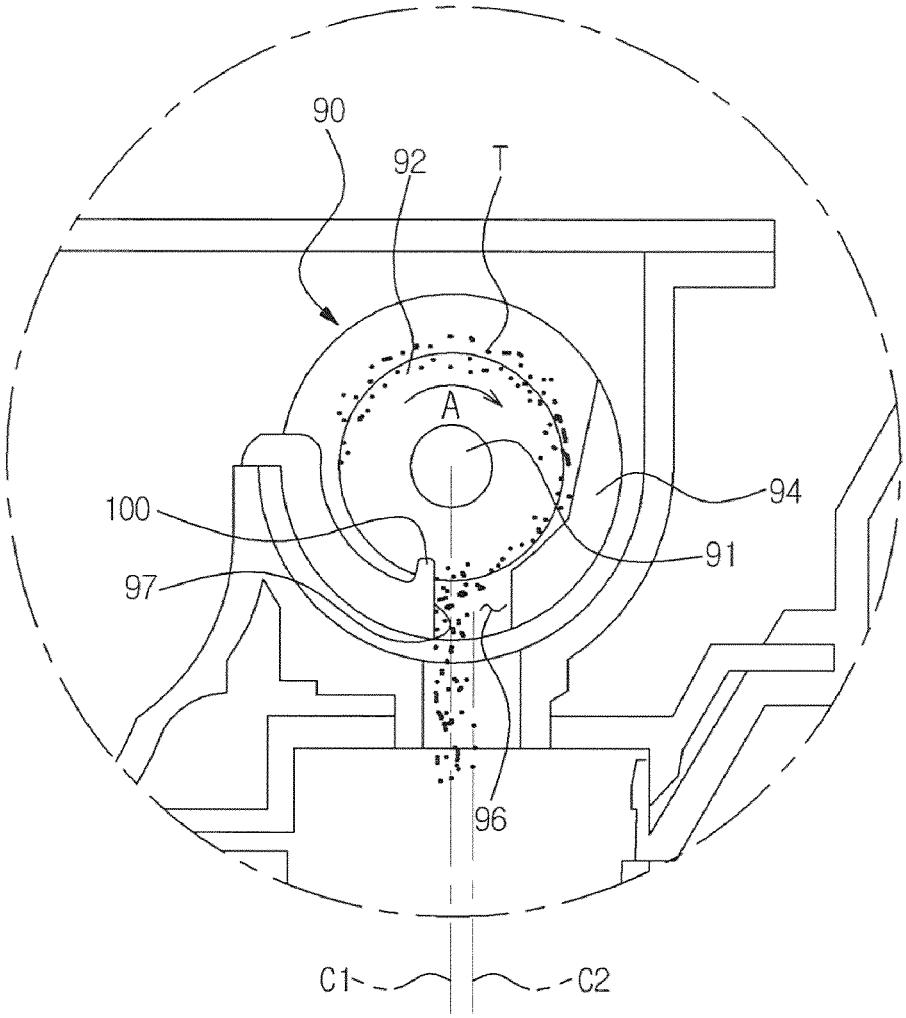
FIG. 3 is an enlarged view illustrating a portion of a developer device depicted inside the dotted circle of FIG. 2.

FIG. 2 is a sectional view of the developing device of FIG. 1, and FIG. 3 is an enlarged view of a portion of the developing device of FIG. 2.

As shown in the drawings, the developing device 40 in accordance with an embodiment may include the developing unit 50 and the developer cartridge 60.

The developing unit 50 forms a visible image by applying the developer T to the image carrier 52. Although the present embodiment describes the single developing unit 50, an image forming apparatus capable of printing a color image may include a plurality of developing units to correspond to respective colors. According to the embodiment, the developing unit 50 may incorporate a developer delivery unit 54, a developer agitating unit 56, a developing member 58 and an image carrier 52.

The developer delivery unit 54 may be arranged below the developer cartridge 60 as shown. The developer T falls into the developer delivery unit 54 from the upper side of the developer delivery unit 54. As the developer delivery unit 54 rotates, the developer T in the developer delivery unit 54 is moved toward the developer agitating unit 56 by a developer delivery unit blade 55.

The developer agitating unit 56 has a plurality of ribs 57. The developer agitating unit 56 redelivers the developer T, which had been delivered from the developer delivery unit 54, to the developing member 58, and may also agitate the developer T.

The developing member 58 feeds the developer T to the image carrier 52, to develop an electrostatic latent image formed on the image carrier 52 into a visible image. Specifically, the developer T, fed by the developer agitating unit 56, is attached to a surface of the developing member 58 by, for example, electromagnetic force or electrostatic force. The developer T, attached to the surface of the developing member 58 with an irregular thickness, may be regulated to substantially uniform thickness while passing through a regulating blade 59. As the developing member 58 rotates, the developer T on a portion of the developing member 58 close to the image carrier 52 is supplied to the image carrier 52, during which the developing member 58 may or may not be in contact with the image carrier 52.

The image carrier 52 may be a rotatable drum. Although the present embodiment describes the drum type image carrier 52, the image carrier 52 may be other types, for example, a belt type image carrier is also possible. The image carrier 52 is charged with a predetermined electric potential by a charge roller 53. As the light emitted from the light scanning device 30 (FIG. 1) is irradiated to the charged surface, an electrostatic latent image is formed. Then, the developer T fed from the developing member 58 is attached to the electrostatic latent image, forming a visible image. The developer T is transferred to the printing medium P (FIG. 1) while the printing medium P (FIG. 1) passes through between the image carrier 52 and the transfer roller 51.

The developer cartridge 60 receives the developer T therein and, according to an embodiment, may be detachably provided in the image forming apparatus 10 so as to allow the replacement thereof or replenishment of developer when all of the developer T stored in the developer cartridge 60 is exhausted after a number of printing operations over time. According to an embodiment, the developer cartridge 60 may be provided separate from other constituent parts to allow individual replacement, which may result in a reduction in overall maintenance costs associated with the image forming apparatus. Although the embodiment of the present invention describes the single developer cartridge 60, a plurality of developer cartridges 60 receiving different colors of developers may also be used. The developer cartridge 60 includes a cartridge housing 61, a developer receiving space 62 defined in the cartridge housing 61, a first developer delivery unit 63 to deliver the developer T received in the developer receiving space 62, and a second developer delivery unit 90 to feed the developer T delivered from the first developer delivery unit 63 into the developing unit 50.

The cartridge housing 61 forms an outer appearance of the developer cartridge 60. According to an embodiment, the cartridge housing 61 may be provided separable from the developing unit 50, and may thus be separately replaceable.

The first developer delivery unit 63 may include first and second rotating shafts 65 and 68 and first and second arms 66 and 69 attached to the first and second rotating shafts 65 and 68, respectively. The first and second rotating shafts 65 and 68 are rotated by a drive device (not shown). As the first and second rotating shafts 65 and 68 rotate, the first and second arms 66 and 69, e.g., in the form of thin films, rotate, delivering the developer T received in the developer receiving space 62 to the second developer delivery unit 90. More specifically, as the first rotating shaft 65 is rotated counterclockwise relative to the drawing, the first arm 66 of the first rotating shaft 65 delivers the developer T toward the second rotating shaft 68. The second arm 69 of the second rotating shaft 68 is also rotated counterclockwise relative to the drawing, delivering the developer T toward the second developer delivery unit 90. In this case, the first rotating shaft 65 located at a relatively lower position pushes up the developer T toward the second rotating shaft 68 located at a relatively upper position. This is similarly applied to arrangement relationship of the second rotating shaft 68 and the second developer delivery unit 90. The second developer delivery unit 90 has a delivery member 92, which, as shown in FIG. 3, rotates clockwise A to discharge the developer T through a feed hole 96 of the developer cartridge 60.

In the embodiment shown, the relative positions and rotations of the first and second rotating shafts 65 and 68 and the second developer delivery unit 90 are arranged with the regulation of the feeding amount of the developer T in mind. Specifically, in this embodiment, as a result of locating the first rotating shaft 65 at a lower height than the second rotating shaft 68, an excessive accumulation of the developer T in proximity of the second rotating shaft 68 may be avoided even if a large amount of the developer T were to be received in the developer receiving space 62. That is, had the first and second rotating shafts 65 and 68 provided at the same height, it is possible that the developer T may be pushed toward the second rotating shaft 68 even without the delivery force by rotation of the first rotating shaft 65, which may result in excessive feeding of the developer T. The above-described arrangement relationship between the first and second rotating shafts 65 and 68 may be equally applicable to the arrangement relationship between the second rotating shaft 68 and the second developer delivery unit 90.

According to an embodiment, while the first and second rotating shafts 65 and 68 are arranged to rotate counterclockwise relative to the drawing, the delivery member 92 of the second developer delivery unit 90 is arranged to rotate clockwise, i.e., in the direction of the arrow A. If the delivery member 92 were to rotate in the same direction as the first and second rotating shafts 65 and 68, e.g., in counterclockwise direction relative to the drawing, it is possible that a substantial amount of the developer T delivered by the rotation of the first and second rotating shafts 65 and 68 may be fed to the delivery member 92 too quickly, an amount of residual developer T being accumulated between the second developer delivery unit 90 and the cartridge housing 61, which may in turn prevent the proper rotation of the delivery member 92. The accumulated residual developer T may further have an adverse effect on the physical properties of the developer T. Accordingly, in an embodiment, the delivery member 92 of the second developer delivery unit 90 is arranged to rotate in opposite direction, such as the clockwise direction A in this example, with respect to the direction of rotation of the first and second rotating shafts 65 and 68 to improve the efficiency in the delivery of the developer T.

The second developer delivery unit 90 discharges the developer T delivered from the first developer delivery unit 63 to the outside of the developer cartridge 60. That is, the second developer delivery unit 90 feeds the developer T into the developing unit 50. The second developer delivery unit 90 includes the delivery member 92 and a receiving member 94, into which the delivery member 92 is received.

The delivery member 92 is rotated about a delivery member shaft 91 carrying the developer T on the surface thereof. Although it varies from one type of developer to another, a single-component developer T may have a diameter of, e.g., approximately 10 μm while a dual-component developer T may have a diameter of, e.g., approximately 40 μm. The delivery member 92 may be made of a porous sponge material and receiving pores (not shown) with a larger diameter than the diameter of the developer T finely formed on the surface of the delivery member 92. Accordingly, the developer T fed to the delivery member 92 becomes attached to the receiving pores (not shown) in the surface of the delivery member 92, and may permeate the surface of the delivery member 92 to a certain depth. The rotation delivery member 92 may be controlled based on the amount of the developer T required to print an image on the printing medium P (FIG. 1).

The receiving member 94 receives the delivery member 92. The receiving member 94 may be provided with shaft holes 93 (FIG. 4) such that the delivery member shaft 91 (FIG. 4) is rotatably received into the shaft holes 93. An upper end of the delivery member 92 is exposed to the developer T fed from the first developer delivery unit 63. The developer T fed to an upper portion of the delivery member 92 is carried by the delivery member 92 toward the receiving member 94. The receiving member 94 may be provided with the feed hole 96 and a contact portion 100.

The feed hole 96 is perforated in the lower end of the receiving member 94 along a longitudinal direction of the delivery member 92. The developer T is fed through the feed hole 96 to the developer delivery unit 54 (FIG. 2) of the developing unit 50 provided below the feed hole 96. The central axis C1 of the delivery member 92 and the central axis C2 of the feed hole 96 may be spaced apart from each other as depicted in FIG. 3. Preferably, the center axis C2 of the feed hole 96 is located upstream of the center axis C1 of the delivery member 92 relative to the rotating direction of the delivery member 92. The developer T is delivered as the delivery member 92 is rotating clockwise A, and falls from the developer cartridge 60 when it reaches the feed hole 96. In this case, some developer T separated from the delivery member 92 still has some rotational inertial force acting on it due to the rotation of the delivery member 92, and therefore may pass through the feed hole 96 in an oblique stream path from the upper right side to the lower left side of the feed hole 96 as it is shown in FIG. 3. The developer T, separated from the delivery member 92 by the contact portion 100, on the other hand, may pass through the feed hole 96 while defining a downward stream. When the oblique stream from the upper right side to the lower left side is mixed with the downward stream, it may hinder efficient feeding of the developer T due to collision between the two steams of the developer T. To mitigate this phenomenon, on accordance with an embodiment, the center axis C2 of the feed hole 96 is located upstream of the center axis C1 of the delivery member 92 with respect to the rotating direction of the delivery member 92 so as to reduce the collision between the two developer streams. The contact portion 100 may be provided at one side of the feed hole 96.

The contact portion 100 may be a contact rib protruding upward from the feed hole 96 toward the delivery member 92. The contact portion 100 may be formed along the entire feed hole 96, or may extend along only a part of the feed hole 96. According to the embodiment shown in FIG. 3, the contact portion 100 extends upward from the downstream sidewall surface 97 of the receiving member 94, that is the sidewall at the downstream side in terms of the rotating direction A of the delivery member 92 among the sidewalls defining the feed hole 96. As mentioned above, the delivery member 92 may be made of porous sponge material, and the developer T is attached to the surface of the delivery member 92 so as to permeate the delivery member 92 to a certain depth. If the developer T attached to the delivery member 92 is brought into contact with the contact portion 100 via rotation of the delivery member 92, the porous delivery member 92 undergoes a local deformation by the contact portion 100, causing the developer T to be separated from the delivery member 92. The developer T, separated from the delivery member 92 via interference with the contact portion 100, falls into the developer delivery unit 54. The contact portion 100 applies an appropriate pressure to the delivery member 92, enabling efficient separation of the developer T attached to the delivery member 92. If the contact pressure at the contact portion 100 becomes excessive, the separation amount of the developer T may increase, however, the porous delivery member 92 may suffer increased abrasion and damage. That is, the porous delivery member 92 has surface cells, into which the developer T may enter to be delivered via rotation of the delivery member 92. The developer T in the cells may act to harden the surface of the porous delivery member 92. The delivery member 92 so hardened by the developer T, when it comes into frictional contact with the contact portion 100, may be subjected to surface abrasion. Further, if the friction between the contact portion 100 and the delivery member 92 becomes excessive, the drive force necessary to drive the delivery member 92 may also increase.

Figure 4:
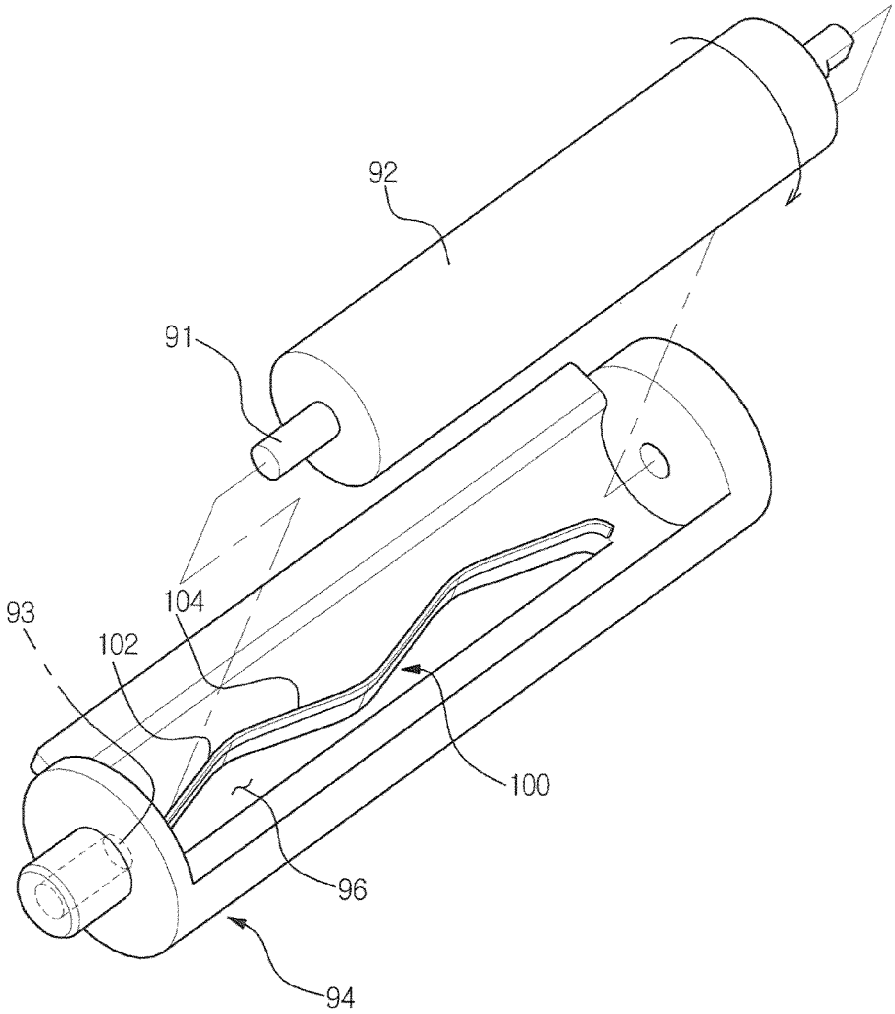
FIG. 4 is an exploded perspective view illustrating a configuration, including a contact portion, of the developer cartridge of FIG. 2.
Figure 5:
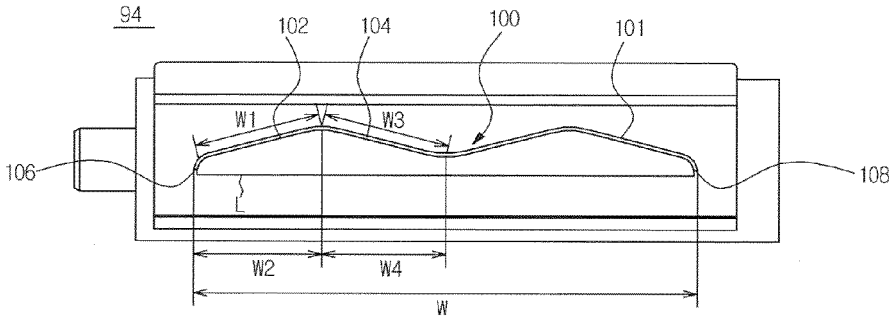
FIG. 5 is a plan view illustrating the contact portion of the developer cartridge of FIG. 4.

FIG. 4 is an exploded perspective view illustrating the contact portion of the developer cartridge of FIG. 2, and FIG. 5 is a plan view of the contact portion of the developer cartridge of FIG. 4.

As shown in the drawings, the contact portion 100 in accordance with an embodiment may include first contact portions 102 and second contact portions 104.

The contact portion 100 has a curvature length longer than the straight distance W, the straight distance W being the length of a straight line L connecting the beginning end point 106 and an ending end point 108 of the contact portion 100. The contact portion 100, having the longer length than the straight distance W, greater contact between the contact portion 100 and the delivery member 92 may be achieved without requiring additional space. That is, as compared to a contact portion in the form of a straight line connecting the end points 106 and 108, the contact portion 100 has a greater total length and thus an increased total effective contact area with the delivery member 92. With the greater effective contact area between the delivery member 92 and the contact portion 100, greater separation amount of the developer T (FIG. 3) attached to the delivery member 92 may be achieved.

In addition, if the total area of the contact portion 100 is increased, the required pressure per unit area of the contact portion 100 to be applied by the delivery member 92 may be reduced. With the reduction in the pressure per unit area, the likelihood of abrasion of and damage to the delivery member 92 by the contact portion 100 as well as the drive force required to drive the delivery member 92 can be reduced. In the present embodiment, the contact portion 100 includes the two first contact portions 102 and the two second contact portions 104, which are alternately arranged to have an M-shaped cross section.

In reference to the straight line L between the end points 106 and 108, the first contact portions 102 may extend obliquely away from the straight line L. That is, the first contact portions 102 may be inclined by a predetermined inclination angle with respect to the straight line L. Accordingly, the length W1 of each first contact portion 102 is longer than the straight distance W2. Therefore, as compared to the case where the contact portion 100 is provided parallel to the straight line L, when the first contact portions extend at an angle with respect to the straight line L, an increased contact area between the contact portion 100 and the delivery member 92 may be achieved.

The second contact portions 104 extend obliquely towards to the straight line L. A length W3 of each second contact portion 104 is longer than the straight distance W4. Accordingly, it can be appreciated that the sum of the lengths W1 and W3 of the first and second contact portions 102 and 104 is larger than the sum of the straight distances W2 and W4.

Figure 6:
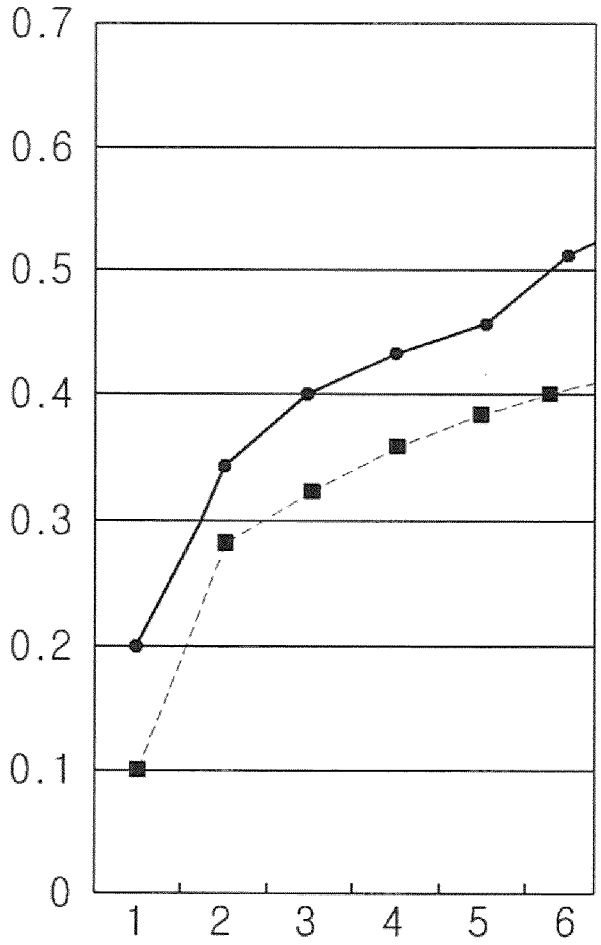
FIG. 6 is a graph illustrating the performance of the image forming apparatus of FIG. 1.

FIG. 6 is a graph illustrating the performance of the image forming apparatus of FIG. 1.

In the graph of FIG. 6, the abscissa represents unit time, and the ordinate represents the amount of the developer fed per unit time. In FIG. 6, the dotted line represents the amount of developer according to a conventional straight contact portion, and the solid line represents the amount of developer according to the above-described contact portion in accordance with an embodiment of the present invention.

The results of measurements of the amount of the developer fed over varying number of unit time is shown. It can be seen from FIG. 6 that the feeding amount of the developer (represented by the solid line) obtained by the contact portion according to the present embodiment is significantly greater than, i.e., up to two times, that of the feeding amount of the developer (represented by the dotted line) according to a conventional straight contact portion. The results shown are attributable to the increased contact area between the delivery member 92 and the contact portion 100.

Figure 7:
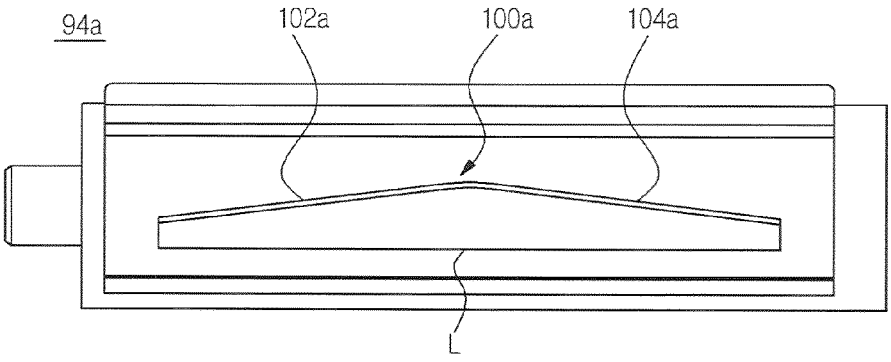
FIG. 7 is a plan view illustrating a receiving member in accordance with an embodiment of the present invention.

FIG. 7 is a plan view illustrating a receiving member in accordance with another embodiment. For the sake of brevity, only those aspects that differs from the embodiment already described above will be described, with the common features being assigned the same reference numerals while those features specific to the embodiment of FIG. 7 being designated by reference numerals to which 'a' is added.

As shown, the receiving member 94*a* in accordance with this embodiment may include a contact portion 100*a*, which is divided into a first contact portion 102*a* and a second contact portion 104*a*.

The first contact portion 102*a* extends obliquely away from the straight line L and the second contact portion 104*a* extends obliquely towards to the straight line L. Accordingly, as compared to a straight contact portion parallel to the straight line L, the contact portion 100*a* has an increased contact area with the delivery member 92.

Figure 8:
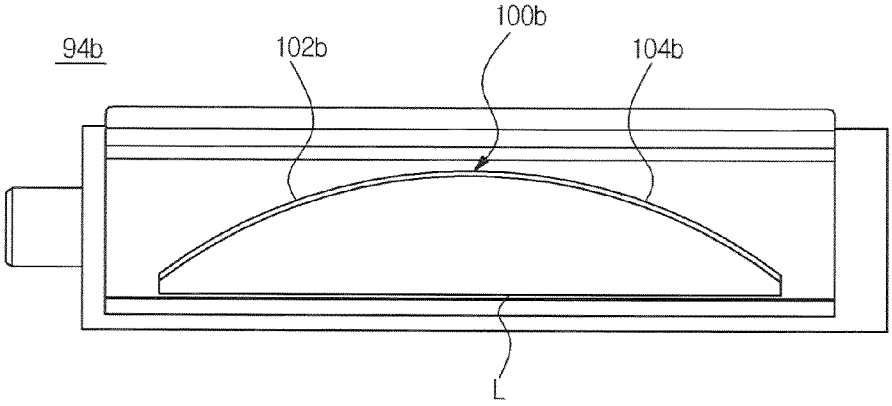
FIG. 8 is a plan view illustrating a receiving member in accordance with another embodiment.

FIG. 8 is a plan view illustrating a receiving member in accordance with another embodiment. Again, for the sake of brevity, only those aspects that differs from the embodiment already described above will be described, with the common features being assigned the same reference numerals while those features specific to the embodiment of FIG. 8 being designated by reference numerals to which 'b' is added.

As shown, the receiving member 94*b* in accordance with the embodiment may include a contact portion 100*b* divided into a first contact portion 102*b* and a second contact portion 104*b*, which are curved with inclinations gradually increasing or decreasing with respect to the straight line L. While the contact portion 100*b* according to this embodiment is shown to have only the two neighboring contact portions, first and second contact portions 102*b* and 104*b*, any number of contact portions 102*b* and 104*b* may be provided.

Figure 9:
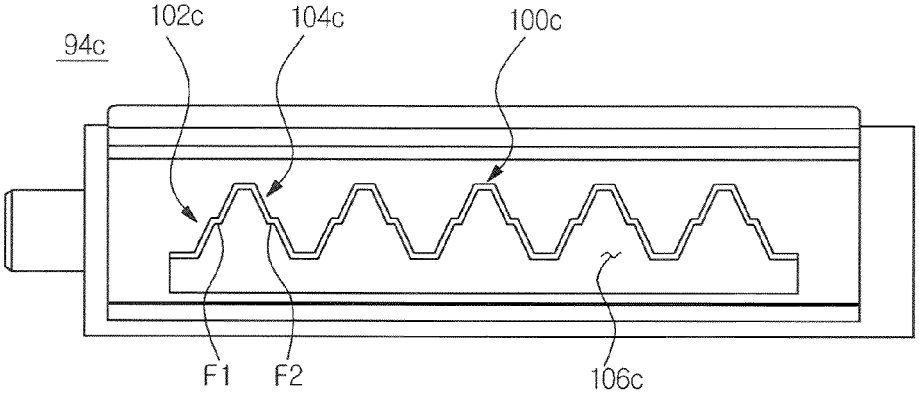
FIG. 9 is a plan view illustrating a receiving member in accordance with yet another embodiment of the present invention.

FIG. 9 is a plan view illustrating a receiving member in accordance with yet another embodiment. Again, for the sake of brevity, the common features are assigned the same reference numerals as the earlier described embodiments while those features specific to the embodiment of FIG. 9 are designated by reference numerals to which 'c' is added.

As shown, the receiving member 94*c* in accordance with the embodiment may include a plural contact portions 100*c* each consisting of two first contact portions 102*c* and two second contact portions 104*c*. That is, the two first contact portions 102*c* are arranged in succession with the first flat plane F1 interposed therebetween, and the two second contact portions 104*c* are arranged in succession with the second flat plane F2 interposed therebetween. The contact portions 100*c* in accordance with this embodiment can achieve not only an increased overall length thereof, but also an increased size of a feed hole 96*c*. In addition, with provision of the first and second flat planes F1 and F2, the contact portions 100*c* can maintain certain level of strength.

Although embodiments of the present invention have been shown and described, it would be appreciated by those skilled in the art that changes may be made to the above embodiments without departing from the principles and spirit of aspects of the invention, the scope of which is defined in the claims and their equivalents.

What is claimed is:

1. A developer cartridge, comprising:

a cartridge housing; and a first developer delivery unit disposed in the cartridge housing, the first developer delivery unit being configured to deliver an amount of developer from the cartridge housing to outside the cartridge housing, the first developer delivery unit including a delivery member, a receiving member configured to receive therein the delivery member and a contact portion configured to come into contact with the delivery member and extending from one end to the other end in a non-straight line, the contact portion having a length from one end thereof to the other end that is longer than a straight line between the ends of the contact portion, wherein the receiving member includes a feed hole having a first shape, and wherein the contact portion comprises a contact rib protruding from the receiving member toward the delivery member at a constant height, the contact rib having a shape of the first shape of the feed hole.

2. The cartridge according to claim 1, wherein the contact portion includes at least one first contact portion and at least one second contact portion, each of the at least one first contact portion being non-parallel to the at least one second contact portion and non-parallel to the straight line.

3. The cartridge according to claim 2, wherein the at least one first contact portion comprises a plurality of first contact portions, the at least one second contact portion comprising a plurality of second contact portions, the plurality of first contact portions and the plurality of second contact portions being arranged in an alternating manner.

4. The cartridge according to claim 2, wherein both the at least one first and at least one second contact portions maintain a predetermined angle with respect to the straight line.

5. The cartridge according to claim 2, wherein any one of the at least one first and the at least one second contact portions is curved.

6. The cartridge according to claim 1, wherein the delivery member rotates in a rotational direction about a rotational axis, the feed hole being defined between a first sidewall and a second sidewall, the first sidewall being further downstream of the second sidewall with respect to the rotational direction of the delivery member, the rotational axis of the delivery member being located closer to the first sidewall than to the second sidewall.

7. The cartridge according to claim 6, wherein the contact portion is provided adjacent the first sidewall of the feed hole.

8. The cartridge according to claim 1, further comprising: a second developer delivery unit having a second delivery member, the delivery member of the first developer delivery unit rotating in a direction opposite to a rotating direction of the second delivery member of the second developer delivery unit.

9. The cartridge according to claim 8, wherein the at least second developer delivery unit is disposed within the cartridge housing at a location lower that the first developer delivery unit to deliver the developer in the cartridge housing in an upward direction toward the first developer delivery unit.

10. A developing device including a developing member configured to convey developer to an image carrier, comprising:

a developer cartridge configured to feed the developer to the developing member, the developer cartridge including a developer receiving space and at least one developer delivery unit to deliver the developer received in the developer receiving space, wherein the developer delivery unit includes a delivery member, a receiving member configured to receive therein the delivery member and including a feed hole having a first shape, and a contact portion configured to come into contact with the delivery member so as to cause separation of the developer attached to the delivery member and extending from one end to the other end in a non-straight line, and wherein the contact between the contact portion and the delivery member has a total contact length longer than a straight line connecting one end of the contact portion to the other end of the contact portion, wherein the contact portion comprises a contact rib protruding from the receiving member toward the delivery member at a constant height, the contact rib having a shape of the first shape of the feed hole.

11. The device according to claim 10, wherein the contact portion includes at least one first contact portion and at least one second contact portion, each of the at least one first contact portion being non-parallel to the at least one second contact portion and non-parallel to the straight line.

12. The device according to claim 11, wherein the at least one first contact portion comprises a plurality of first contact portions, the at least one second contact portion comprising a plurality of second contact portions, the plurality of first contact portions and the plurality of second contact portions being arranged in an alternating manner.

13. An image forming apparatus including an exposing unit to irradiate light on an image carrier to form thereon an electrostatic latent image and a developing device including a developing member to convey developer to the image carrier, comprising:

a developer cartridge configured to feed the developer to the developing member, the developer cartridge including a developer delivery unit to deliver the developer received in the developer cartridge, wherein the developer delivery unit includes a delivery member and a receiving member configured to receive the delivery member, the receiving member including a feed hole having a first shape and including a contact portion having a shape of the first shape of the feed hole and extending from one end to the other end in a non-straight line to come into contact with the delivery member, and wherein the contact portion has at least two positions being spaced apart by different perpendicular distance from a straight line connecting one end of the contact portion to the other end of the contact portion, wherein the contact portion comprises a contact rib protruding from the receiving member toward the delivery member at a constant height, the contact rib having a shape of the first shape of the feed hole.

14. The apparatus according to claim 13, wherein the contact portion includes at least one first contact portion positions along which having increasing perpendicular distance from the straight line and at least one second contact portion positions along which having decreasing perpendicular distance from the straight line.

15. The apparatus according to claim 14, wherein the at least one first contact portion comprises a plurality of first contact portions, the at least one second contact portion comprising a plurality of second contact portions, the plurality of first contact portions and the plurality of second contact portions being arranged in an alternating manner.

* * * * *